United States Patent [19]

Aoki et al.

[11] Patent Number: 4,868,554

[45] Date of Patent: Sep. 19, 1989

[54] DISPLAY APPARATUS

[75] Inventors: Takaaki Aoki, Raleigh, N.C.; Katsuyuki Nojima, Yokohama; Yoji Seki, Fujisawa, both of Japan

[73] Assignee: International Business Machines Corporation, Armonk, N.Y.

[21] Appl. No.: 156,875

[22] Filed: Feb. 18, 1988

[30] Foreign Application Priority Data

Mar. 5, 1987 [JP] Japan ..... 62-49012

[51] Int. Cl.[4] ..... G09G 1/16

[52] U.S. Cl. ..... 340/735; 340/703; 340/748

[58] Field of Search ..... 340/735, 721, 731, 732, 340/748, 749, 750, 799, 701, 702, 703, 747, 798, 723, 726, 709

[56] References Cited

U.S. PATENT DOCUMENTS

| | | | |
|---|---|---|---|
| 4,384,285 | 5/1983 | Long et al. | 340/723 |
| 4,394,650 | 7/1983 | Long et al. | 340/747 |
| 4,398,190 | 8/1983 | Long et al. | 340/723 |
| 4,642,789 | 2/1987 | Lavelle | 340/709 |
| 4,642,794 | 2/1987 | Lavelle et al. | 340/726 |
| 4,646,261 | 2/1987 | Ng | 340/750 |
| 4,742,350 | 5/1988 | Ko et al. | 340/735 |
| 4,760,390 | 7/1988 | Maine et al. | 340/721 |
| 4,763,118 | 8/1988 | Takai | 340/735 |
| 4,794,389 | 12/1988 | Luck et al. | 340/799 |

FOREIGN PATENT DOCUMENTS 55-78336 6/1980 Japan .

*Primary Examiner*—David K. Moore
*Assistant Examiner*—M. Fatahiyar
*Attorney, Agent, or Firm*—Marc D. Schechter

[57] ABSTRACT

A raster scan type display apparatus for displaying characters having attributes. The attributes are, for example: (i) underlining, (ii) reverse video, (iii) high intensity, and (iv) blinking. The characters and attributes are stored in a refresh memmory. The display may be operated in either a field attribute mode or in a character attribute mode. In the field attribute mode, one field attribute byte in the refresh memory sets the attributes for at least one, but usually many characters which follow the field attribute byte in the refresh memory. In the character attribute mode, one character attribute byte in the refresh memory sets the attribute for only one character which precedes the character attribute in the refresh memory. In the character attribute mode, field attributes may be provided (in addition to the character attributes) for strings of characters following the field attributes.

17 Claims, 7 Drawing Sheets

FIG. 4A
| | |
|---|---|
| P | FA1 |
| P+1 | CC1 |
| P+2 | CC2 |
| P+3 | CC3 |
| P+4 | FA2 |
| P+5 | CC4 |
| P+6 | CC5 |
| P+7 | CC6 |
| P+8 | CC7 |
| P+9 | CC8 |
FIG. 4B
| | |
|---|---|
| P | CC1 |
| P+1 | CA1 |
| P+2 | CC2 |
| P+3 | CA2 |
| P+4 | CC3 |
| P+5 | CA3 |
| P+6 | CC4 |
| P+7 | CA4 |
| P+8 | CC5 |
| P+9 | CA5 |
FIG. 4C
| | |
|---|---|
| P | FAF |
| P+1 | FA1 |
| P+2 | CC2 |
| P+3 | CA2 |
| P+4 | CC3 |
| P+5 | CA3 |
| P+6 | CC4 |
| P+7 | CA4 |
| P+8 | CC5 |
| P+9 | CA5 |
FIG. 5A
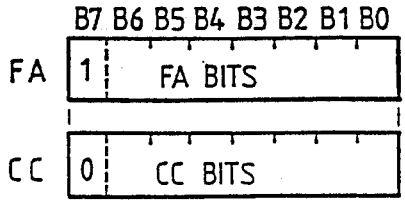
FIG. 5B
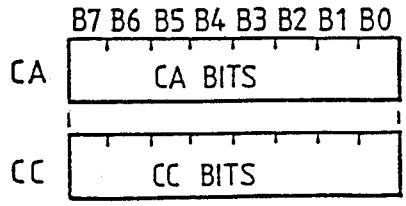
FIG. 5C
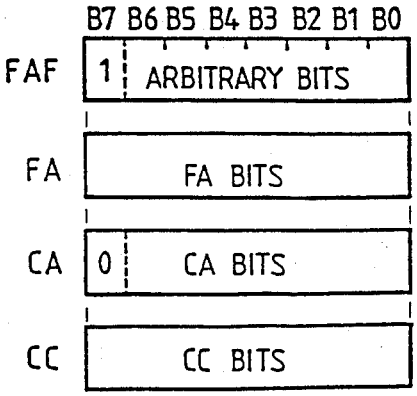

FIG. 9A
(PRIOR ART)

| B10 | B9 | B8 | B7 | B6 B5 B4 B3 B2 B1 B0 |
|---|---|---|---|---|
| B | G | R | 0 | CHARACTER CODE |

FIG. 9B
(PRIOR ART)

| | | | | |
|---|---|---|---|---|
| B | G | R | 1 | FIELD ATTRIBUTE |

DISPLAY APPARATUS

BACKGROUND OF THE INVENTION

The present invention generally relates to a raster scanning type display apparatus, and more particularly, to a display apparatus having an attribute controlling function.

Two typical techniques are known for using control codes called attributes to control the display modes of characters. The first is a technique using one character attribute for each character. Display devices which use this technique include those of the type which store character codes and character attributes alternately at successive locations of a memory and those of the type which store the character codes and the character attributes in separate memories or memory areas.

The second is a technique using field attributes. Each field attribute determines the display mode of a group of characters. In this technique, field attributes for groups of characters are stored in successive locations of a memory.

Generally, a display apparatus which uses either the first or second technique is constructed so as to enable only the use of either field attributes or character attributes but not the use of both of them. In consideration of such circumstances, there has been proposed a third technique which enables the use of both kinds of attributes. Namely, a technique disclosed in Japanese Published Unexamined Patent Application No. 55-78336 uses both field attributes and character attributes by using codes having the special format illustrated in FIG. 9. More specifically, the higher three bits B8–B10 of a code consisting of eleven bits B0–B10 are allocated as a character attribute, and the bit B7 is set to 0 or 1 to indicate whether the lower seven bits B0–B6 constitute a character code or a field attribute.

While the third technique is desirable to attain a versatile attribute control, the technique disclosed in the above Japanese Published Unexamined Patent Application No. 55-78336 has the problem that the memory is not effectively used. Namely, since each of the codes stored in successive storage locations includes a portion allocated as a character attribute, it is apparent that such character attribute portions in all the codes in the memory would be of no use and the spaces storing them would be wasted in a situation in which only field attributes are used without using any character attribute.

Although only three bits are included in each of the character attribute portions in the above prior technique, it would generally be necessary at present to allocate many more bits as a character attribute for determining various display modes, such as a reverse display, a high intensity display, a blinking display, a display with underlining, etc., which would aggravate the waste of memory space.

Further, the above prior technique using the special code format would not be well suited for use in ordinary information processing in eight-bit bytes and would require a special bus for transmitting the information.

SUMMARY OF THE INVENTION

It is an object of the invention to provide a display device which can use either field attributes or character attributes (or both), while effectively utilizing available memory space.

It is another object of the invention to provide a display apparatus which can use different attribute control modes in a plurality of different segments on the screen divided for a plurality of applications.

It is a further object of the present invention to provide a display device which utilizes information in the form of bytes.

The display apparatus according to the present invention uses three kinds of codes, i.e., character codes (CC's), character attributes (CA's), and field attributes (FA's), without using codes of a special format such as used in the method described in Japanese Published Unexamined Patent Application No. 55-78336. The invention includes means for specifying one of at least two attribute control modes. Depending on the modes specified by the means, the storage mode of a refresh memory and the operation rate of an address generating means associated therewith are varied.

A first control mode is a mode using FA's only and a second control mode is a mode using at least CA's. In the first control mode, the refresh memory stores either an FA or a CC in each of a plurality of sequentially addressable storing locations, and in the second control mode, basically stores CC's and CA's alternately in a plurality of sequentially addressable storing locations.

The address generating means for reading out display data in the refresh memory to be displayed by the display means operates so as to generate successive address signals at a predetermined operation rate in the first control mode, and at an operation rate which is double the predetermined operation rate in the second control mode.

In an embodiment of the present invention which will be explained below, the first control mode is an FA only mode and the second control mode is a CA only mode or an FA/CA mixed mode. In the CA only mode, only CA's are used. In the FA/CA mixed mode, both of FA's and CA's are employed and FA's are stored instead of some of the CA's.

BRIEF DESCRIPTION OF THE DRAWING

FIGS. 4A–4C illustrate the storage modes of the display data in the three control modes of the apparatus of FIG. 1.

FIGS. 5A–5C illustrate the formats of CC's, CA's, and FA's used in the three control modes.

FIGS. 9A–9B illustrate a form of display data used in the prior art.

DESCRIPTION OF THE PREFERRED EMBODIMENTS

Figure 1:
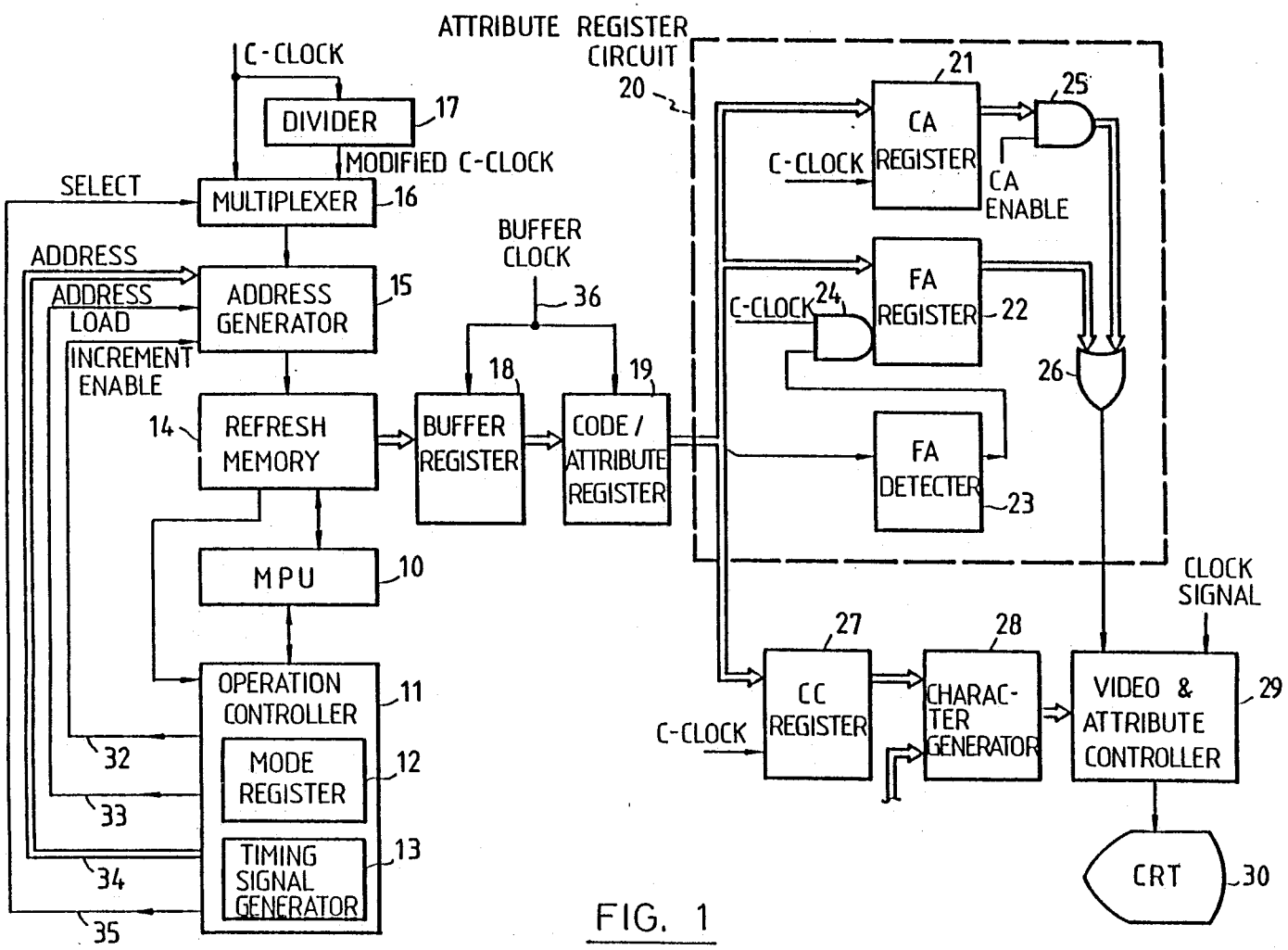
FIG. 1 schematically illustrates an embodiment of the display apparatus according to the present invention.

FIG. 1 illustrates a preferred embodiment of the display apparatus according to the present invention. A refresh memory 14 has stored therein display data selectively including CC's, CA's, and FA's. The display data is stored in the refresh memory 14 under the control of a microprocessor unit (MPU) 10.

The display data is read out according to address signals generated from an address generator 15. The read out display data is transmitted to an attribute register circuit 20 or a CC register 27 through a buffer register 18 for controlling timing and a code/attribute register 19.

The CC register 27 temporarily retains CC's and supplies them as addresses to a character generator 28. The character generator 28 supplies bit patterns (according to the CC's and the line counts generated from a timing signal generator 13 in an operation controller 11) to a video and attribute control circuit 29. The control circuit 29 also receives attribute signals generated from the attribute register circuit 20 and causes the bit patterns to be displayed accordingly on a CRT 30. The attribute register circuit 20 includes a CA register 21 for retaining CA's and an FA register 22 for retaining FA's. This will be described later in more detail.

Figure 2:
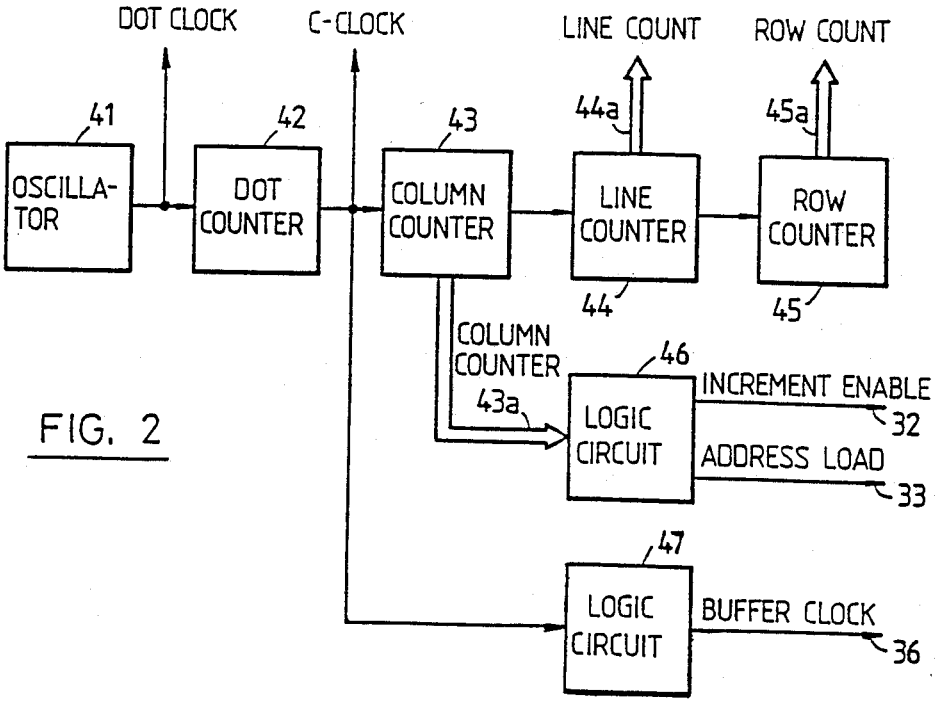
FIG. 2 schematically illustrates an embodiment of the timing signal generator of the apparatus of FIG. 1.

An example of a specific structure for the timing signal generator 13 provided in the operation controller 11 is illustrated in FIG. 2. An oscillator 41, a dot counter 42, a column (or character) counter 43, a line counter 44, and a row counter 45 are respectively of any known structure and are closely related to the display modes on the screen of the CRT 30 (FIG. 1). As an example, now assume that a display consisting of 25 rows×80 columns (characters) is generated on the screen with each row consisting of 15 lines (scanning lines) and each column having a lateral width of 9 dots. In this case, the dot counter 42 counts 0 through 8 repeatedly and generates one C-clock for every nine dot clocks.

The column counter 43 counts 0 through 99 C-clocks and generates column counts indicating columns (character times) being scanned onto an output line 43*a* and also provides the line counter 44 with a pulse each time the counting is repeated. The line counter 44 counts 0 through 14 repeatedly and generates line counts indicating lines being scanned onto an output line 44*a* and also provides the row counter 45 with a pulse each time the counting is repeated. The row counter 45 counts 0 through 27 repeatedly and generates row counts indicating rows on the screen onto an output line 45*a*.

In this example, the column counts 3 through 82 of the column counts 0 through 99 correspond to display times and the remaining column counts correspond to horizontal blanking times. Further, the row counts 0 through 24 of the row counts 0 through 27 correspond to the display times and the remaining row counts correspond to vertical blanking times.

The timing signal generating circuit 13 in FIG. 2 further includes two logic circuits 46 and 47. The logic circuit 46 generates increment enable signals and address load signals on lines 32 and 33 according to the column counts. The address load signals are generated according to the appropriate column counts during the horizontal blanking times, and the increment enable signals are generated while the column counts are 0 through 79. These signals are used in association with the address generator 15, as to be explained later.

The logic circuit 47 generates buffer clock signals onto a line 36. The buffer clock signals have a frequency which is double the frequency of the C-clocks, but are otherwise synchronized with the C-clocks. The buffer clock signals determine the timing of the operations of the registers 18 and 19 described above.

Figure 3:
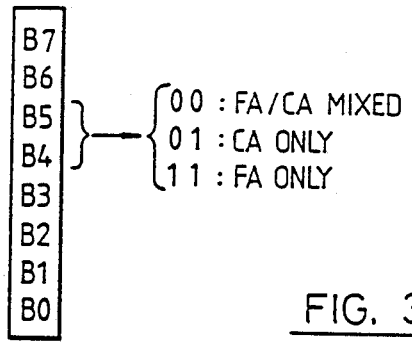
FIG. 3 illustrates the contents of the mode register of FIG. 1.

Referring again to FIG. 1, the operation controller 11 is further provided with a mode register 12. For example, as illustrated in FIG. 3, the mode register 12 stores eight bits B0–B7 for controlling the various operating modes for the display apparatus. In this example, the bits B5 and B4 are used to specify the attribute control modes, and as illustrated, the FA only, CA only, and FA/CA mixed modes are specified respectively by 11, 01, and 00.

The meanings of the three control modes and the storage modes of the display data in the refresh memory 14 are as follows.

FA Only Mode

Only FA's are used. The storage mode of FA's and CC's in the refresh memory in this case is illustrated by (A) in FIG. 4. In the storage location specified with the address P, a field attribute FA1 has been stored and is used to control the display mode of the succeeding character codes CC1–CC3. In the location of the address P+4, the next field attribute FA2 has been stored and is used to control the display mode of the succeeding character codes CC4–CC8.

CA Only Mode

Only CA's are used. In this case, as illustrated by (B) in FIG. 4, the character codes CC1–CC5 and the character attributes CA1–CA5 associated therewith are stored alternately in successive storage locations. In this embodiment, CC's are stored in the even-numbered address locations and CA's are stored in the odd-numbered address locations.

FA/CA Mixed Mode

Both of FA's and CA's are used. As illustrated by (C) in FIG. 4, the display data storage mode in this case is only slightly modified from the CA only mode of storing CC's and CA's alternately. Namely, in this mode, one or more FA's are stored selectively in one or more of the odd-numbered address locations for storing one or more CA's, and an FA flag code (FAF) is stored instead of a CC in the even-numbered address location immediately prior thereto. The FAF is a code indicating that an FA (FA1 in this case) exists in the next address location.

The mode specifying bits B4 and B5 of the mode register 12 are set either by the MPU 10 according to the instruction of the user or by the operation controller 11 using line attributes. To explain further the latter case, since a plurality of line attributes including control information for a plurality of rows on the screen are generally used for the control of a display, a method of introducing mode specifying information into each of the line attributes and setting the mode register 12 for each row according to the mode specifying information in the line attributes may be adopted. As well known in the art, the plurality of line attributes are stored in the refresh memory 14 or any other appropriate storage means as a table, and are sequentially read out in synchronization with the scanning of the screen by the operation controller 11. According to this method, the attribute control mode can be easily changed for each row, so that it is possible, for example, to divide the screen into a plurality of segments for a plurality of applications and use a different attribute control mode for each of the segments.

FIG. 5 illustrates the formats of the display data used in the respective control modes. In all cases, both attribute codes and character codes are in bytes (bits B0–B7).

First, in case of the FA only mode, as illustrated by (A) in FIG. 5, each code is discriminated to be an FA or a CC by binary 1 or 0 of the bit B7. In case of the CA only mode, as illustrated by (B) in FIG. 5, all of the eight bits are used as a CC or a CA. It is not necessary in this mode to use one bit to discriminate between a CC and a CA because it is already known that codes in the even-numbered address locations are CC's and codes in the odd-numbered address locations are CA's.

In case of the FA/CA mixed mode, the format illustrated by (C) in FIG. 5 is used. As stated before, an FAF has the sole function of indicating that an FA follows immediately thereafter. An FAF is recognized by setting the bit B7 equal to 1. All of the bits in an FA can be used as attribute information. In order to distinguish a CA from an FAF, a CA has the bit B7 set equal to 0. All of the bits in a CC can be used to indicate a character.

In any mode, a CA and an FA have respectively a plurality of bits allocated to control the attribute. The attribute may be, for example, a reverse display, a blinking display, a high intensity display, a display with underlining, a blank display, and so on.

Next, the operation of the address generator 15 in FIG. 1 will be explained more in detail. The address generator 15 is a loadable counter. The operation controller 11 has a function of loading start addresses to the address generator 15 via a line 34 at the times of the address load signals stated before. A start address specifies the first of a series of storage locations in the refresh memory 14 storing the display data to be displayed in one row on the screen. The technique employing start addresses is well known in the art and, generally, a plurality of addresses for a plurality of rows are retained as a table in an appropriate storage means to be used as required. The operation controller 11 either incorporates therein such a table storing means, or allocates and accesses specified segments in the refresh memory 14 as a table storing means.

The address generator 15 counts the clocks provided from a multiplexer 16 while increment enable signals are supplied through the line 32 after a start address is loaded. The multiplexer 16 receives C-clocks and modified C-clocks generated from a divider 17 having the function of dividing the frequency of C-clocks in half. Multiplexer 16 gates either of them as clocks for the address generator 15 according to select signals on a line 35. More specifically, the operation controller 11 provides the multiplexer 16 with select signals which cause the modified C-clocks from the divider 17 to be gated in the FA only mode, and which cause C-clocks to be gated in the FA/CA mixed mode.

In this embodiment, the operation controller 11 operates so as to load the address generator 15 with the same start address repeatedly for each count of the line counter 44 while the row counter 45 is indicating one row count. If a row buffer is provided at the output end of the refresh memory 14 to retain the display data for one row to be displayed, the loading of the start address would be needed to be performed only once for each row to be displayed. In that case, a series of corresponding display data are read out into the row buffer only once for each row to be displayed to be used repeatedly for each of a plurality of lines in each row to be displayed.

Figure 6:
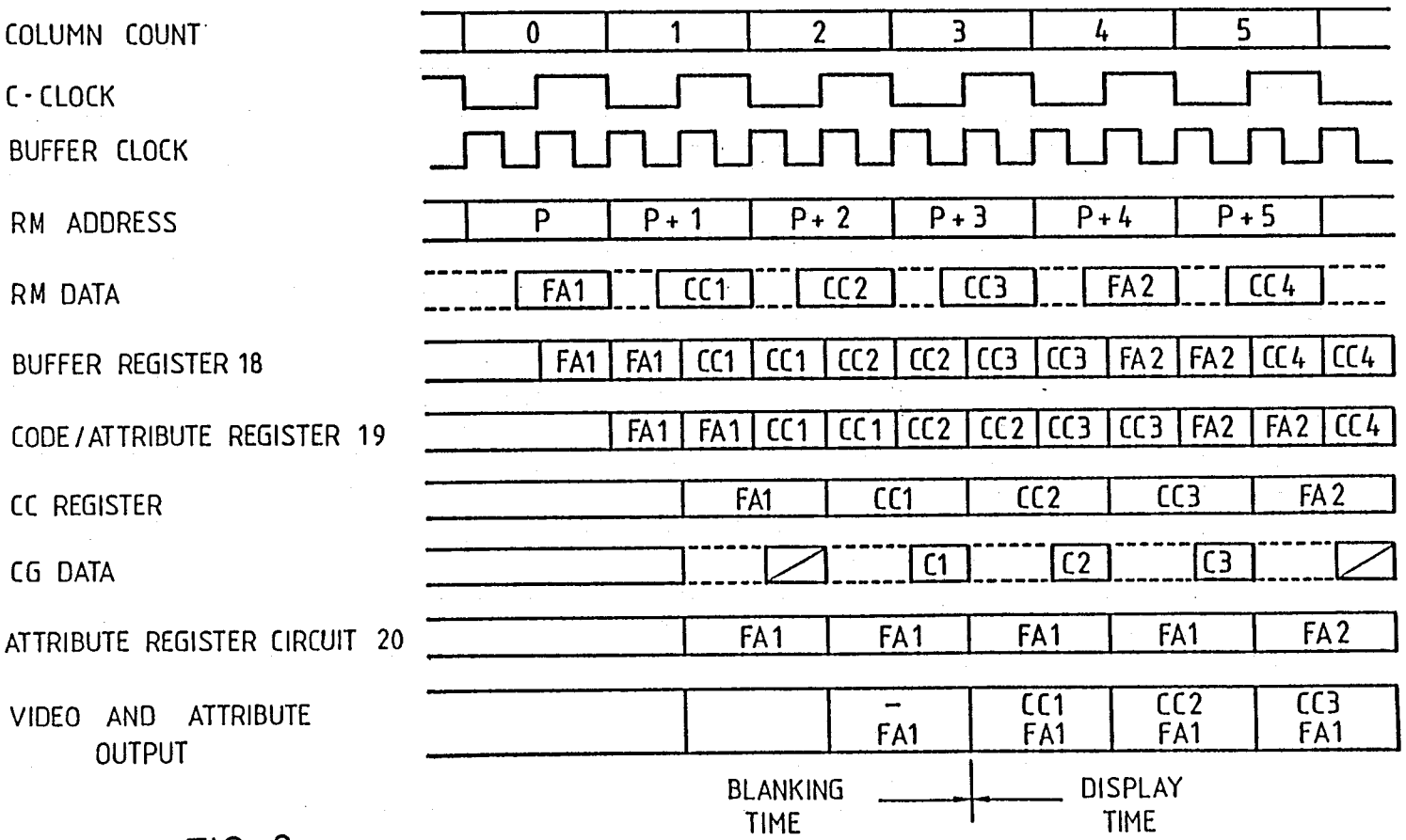
FIGS. 6 through 8 illustrate the timing of the operations of the display apparatus of FIG. 1 in the three control modes.

Now, referring to FIG. 1 and FIGS. 6 through 8, the operating sequence of the display apparatus for handling the display data illustrated in FIG. 4 will be explained in detail. FIG. 6 illustrates the timing for handling the display data illustrated by (A) in FIG. 4 in the FA only mode. First, the address generator 15 is loaded with P as a start address. In the FA only mode, since it is required to read out the display data by one from sequential storage locations in the refresh memory in synchronization with column counts indicating sequential character display times, the address generator 15 increments the address (illustrated in FIG. 6 as RM address) according to successive transitions of modified C-clocks, having half the frequency of C-clocks. According to the successive addresses, refresh memory data (RM data) are read out from a series of storage locations. These data are sequentially transferred to the buffer register 18 and the code/attribute register 19 according to buffer clock signals. The registers 18 and 19 each comprise eight D-type flip-flops (D-FF's).

Next, prior to continuing further with the explanation of the FA-only operation, the structure of the attribute register circuit 20 provided at the output end of the register 19 will be explained. The CA register 21 and the FA register 22 are the registers for retaining CA's and FA's, respectively, and each comprise eight D-type latches. The CA register 21 latches input data according to positive transitions of C-clocks. The FA register 22 latches input data according to positive transitions of C-clocks passing through an AND circuit 24 only when an FA detector 23 is generating outputs. The FA detector 23 detects the bit B7=1 of the field attribute flag FAF, and generates an output when the FAF is found.

The output of the FA register 22 is directly transferred to an OR circuit 26, while the output of the CA register 21 is supplied to the OR circuit 26 through an AND circuit 25 only when CA enable signals are generated. The CA enable signals are generated by the operation controller 11 only in the Ca only mode and the FA/CA mixed mode. Accordingly, in the FA/CA mixed mode, an OR output between an FA and a CA is used as an attribute signal. For example, when an FA specifies a reverse display and a CA specifies blinking, both the reverse and blinking attributes are displayed as to the character associated with the CA.

Now, returning back to the explanation of the timing of the FA-only operation illustrated in FIG. 6, the data read out first which is the field attribute FA1 is received by the FA register 22 and is transferred to the controller 29 to be used to control the display modes. In this embodiment, although the FA1 is also set in the code register 27 and some pattern is generated accordingly from the character generator 28, it causes no problem since the controller 29 suppresses the display in the first cycle in receiving the FA from the FA register 22. The register 27 comprises eight D-FF's.

The CC1, CC2, and CC3 following the FA1 are used as addresses for the character generator 28 via the code register 27, and the patterns of the characters C1, C2, and C3 corresponding thereto are displayed on the CRT 30. At that time, the controller 29 controls the display attribute according to the FA1.

Figure 7:
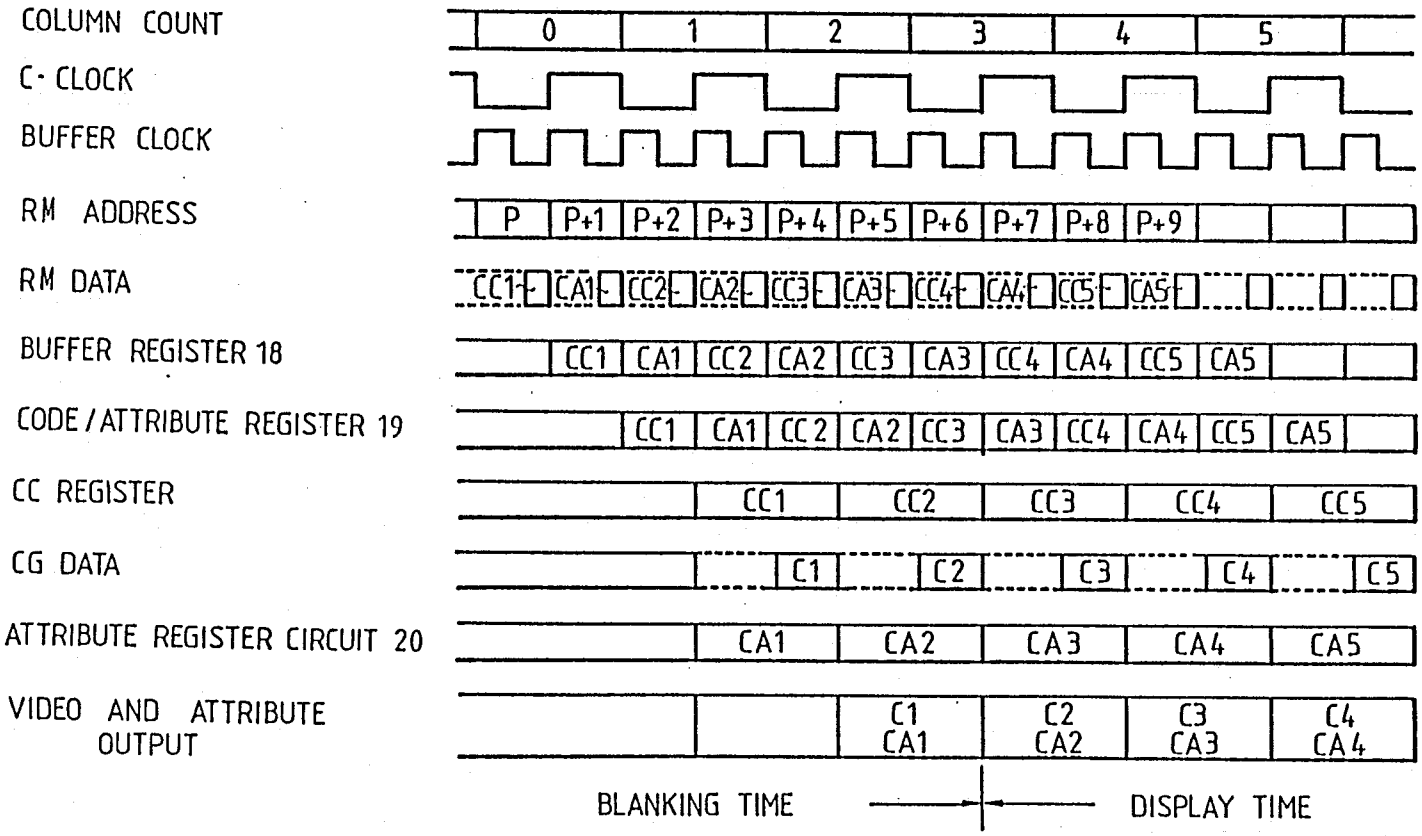

FIG. 7 illustrates the timing of the operation in handling the display data illustrated by (B) in FIG. 4 in the CA only mode. In this mode, since it is required to read out a CC and a CA from two storage locations for each column count corresponding to each character display time, C-clocks are supplied to the address generator 15, and the address generator 15 increments the address according to the successive transitions of the C-clocks. Thus, the characters C1, C2, etc., corresponding to the CC1, CC2, etc., are displayed under the control of CA1, CA2, etc.

Figure 8:
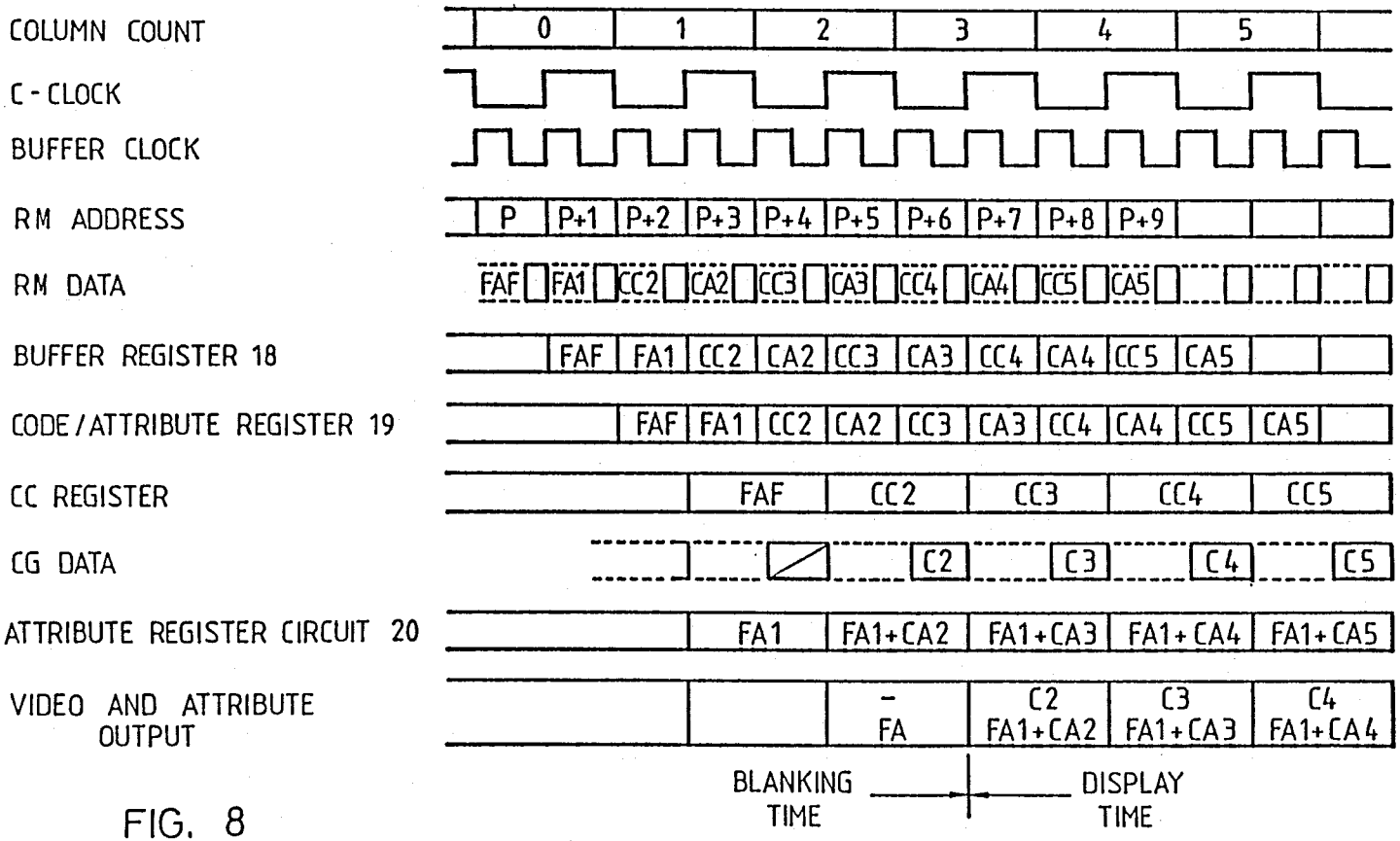

FIG. 8 illustrates the timing of the operation in handling the display data illustrated by (C) in FIG. 4 in the FA/CA mixed mode. This timing of the operation is basically the same as that of the CA only mode. As illustrated, the characters C2, C3, C4, etc., are displayed under the control of FA1+CA2, FA1+CA3, FA1+-CA4, etc.

Having thus described our invention, what we claim as new, and desire to secure by Letters Patent is:

1. A display apparatus of the type which controls display modes of characters with attributes in displaying them by a raster scanning type display means, characterized by comprising:

a mode specifying means which can be set so as to specify selectively a first control mode using field attributes only and a second control mode using at least character attributes;

a refresh memory having a plurality of sequentially addressable storing locations for storing either a field attribute or a character code in each of said plurality of storing locations when said mode specifying means specifies said first control mode and for storing character codes and character attributes alternately in said plurality of storing locations when said mode specifying means specifies said second control mode; and an address generating means associated with said mode specifying means and said refresh memory for generating address signals to read out character codes or attributes in said refresh memory, which means generates successive address signals at a predetermined operation rate when said mode specifying means specifies said first control mode and generates successive address signals at an operation rate which is double the predetermined operation rate when said mode specifying means specifies said second control mode.

2. A display apparatus as described in claim 1, wherein:

said predetermined operation rate of said address generating means is a rate of incrementing one address for each character display time of said display means.

3. A display apparatus as described in claim 1, wherein:

said address generating means is a counter which performs counting according to clock signals and is provided with a means for changing the frequency of said clock signals depending on the specification of said control modes by said mode specifying means.

4. A display apparatus as described in claim 1, wherein:

said mode specifying means indicates selectively, as said second control mode, either a CA only mode using character attributes only or an FA/CA mixed mode using both of field attributes and character attributes, and in said FA/CA mixed mode, one or more field attributes are stored instead of one or more character attributes at one or more storing locations selected in said refresh memory.

5. A display apparatus as described in claim 4, wherein:

the second control mode uses character attributes only or field attributes and character attributes; and a first, a second, and a third means for retaining separately said character codes, character attributes, and field attributes, respectively, are connected to the output bus of said refresh memory, and a logic means for combining each of said one or more character attributes and each of said one or more field attributes into one attribute, when said mode specifying means specifies said second control mode using field attributes and character attributes is provided on the output side of said second and third retaining means.

6. A device for generating a display signal, said device comprising:

a refresh memory having a plurality of sequentially addressable storage locations for storing either an attribute code or a character code;

output means for sequentially reading the codes stored in the refresh memory to produce a display signal; and a controller for operating the device in either a first control mode using field attributes only or a second control mode using at least character attributes, said controller causing the output means to read the codes at a first rate when the device operates in the first control mode, said controller causing the output means to read the codes at a second rate when the device operates in the second control mode, said second rate being twice the first rate.

7. A device as claimed in claim 6, characterized in that in the second mode, character codes are stored at locations in the refresh memory which alternate with locations in the refresh memory at which attribute codes are stored.

8. A device as claimed in claim 7, characterized in that in the second mode, each character is defined by a character code, and each character's attributes are defined by an attribute code immediately following the character code in the refresh memory.

9. A device as claimed in claim 7, characterized in that in the first mode, each field attribute code in the refresh memory defines the attributes of one or more characters defined by a string of one or more character codes immediately following the field attribute code in the refresh memory but preceding the next field attribute code in the refresh memory.

10. A device as claimed in claim 7, characterized in that in the second mode, each field attribute code in the refresh memory defines the attributes of one or more characters defined by a string of one or more character codes immediately following the field attribute code in the refresh memory but preceding the next field attribute code in the refresh memory.

11. A device as claimed in claim 10, further comprising:

a character attribute register for receiving character attribute codes from the refresh memory, each character attribute code corresponding to one character code read out of the refresh register;

a field attribute register for receiving field attribute codes from the refresh memory, each field attribute code corresponding to one or more characters read out of the refresh register; and means for combining the character attribute codes from the character attribute register and the field attribute codes from the field attribute register to provide combined attribute codes, each combined attribute code corresponding to the same character code to which the character and field attribute code components of the combined attribute code correspond.

12. A display device comprising:

a refresh memory having a plurality of sequentially addressable storage locations for storing either an attribute code or a character code; output means for sequentially reading the codes stored in the refresh memory to produce a display signal;

a controller for operating the device in either a first control mode using field attributes only or a second control mode using at least character attributes, said controller causing the output means to read the codes at a first rate when the device operates in the first control mode, said controller causing the output means to read the codes at a second rate when the device operates in the second control mode, said second rate being twice the first rate; and means for receiving the display signal and for producing an image therefrom.

13. A device as claimed in claim 12, characterized in that in the second mode, character codes are stored at locations in the refresh memory which alternate with locations in the refresh memory at which attribute codes are stored.

14. A device as claimed in claim 13, characterized in that in the second mode, each character is defined by a character code, and each character's attributes are defined by an attribute code immediately following the character code in the refresh memory.

15. A device as claimed in claim 13, characterized in that in the first mode, each field attribute code in the refresh memory defines the attributes of one or more characters defined by a string of one or more character codes immediately following the field attribute code in the refresh memory but preceding the next field attribute code in the refresh memory.

16. A device as claimed in claim 13, characterized in that in the second mode, each field attribute code in the refresh memory defines the attributes of one or more characters defined by a string of one or more character codes immediately following the field attribute code in the refresh memory but preceding the next field attribute code in the refresh memory.

17. A device as claimed in claim 16, further comprising:

a character attribute register for receiving character attribute codes from the refresh memory, each character attribute code corresponding to one character code read out of the refresh register;

a field attribute register for receiving field attribute codes from the refresh memory, each field attribute code corresponding to one or more characters read out of the refresh register; and means for combining the character attribute codes from the character attribute register and the field attribute codes from the field attribute register to provide combined attribute codes, each combined attribute code corresponding to the same character code to which the character and field attribute code components of the combined attribute code correspond.

* * * * *